US005186183A

United States Patent [19]

Komori et al.

[11] Patent Number: 5,186,183

[45] Date of Patent: Feb. 16, 1993

[54] METHOD AND APPARATUS FOR DETECTING MICRO-HOLES OR EXAMINING THE STATE OF MICRO-HOLES FORMED ON EACH OF ROD-LIKE MATTERS

[75] Inventors: Mikio Komori; Shuichi Sato; Kazuyu Adachi; Masayoshi Saito, all of Tokyo, Japan

[73] Assignee: Japan Tobacco Inc., Tokyo, Japan

[21] Appl. No.: 623,525

[22] Filed: Dec. 7, 1990

[30] Foreign Application Priority Data

Dec. 8, 1989 [JP] Japan ..... 1-317563

[51] Int. Cl.[5] ..... A24C 5/00

[52] U.S. Cl. ..... 131/281; 131/904; 73/38; 73/41

[58] Field of Search ..... 131/280, 281, 904; 73/37, 37.5, 38, 40, 45, 45.1, 45.2

[56] References Cited

U.S. PATENT DOCUMENTS

| | | | |
|---|---|---|---|
| 4,034,600 | 7/1977 | Motle | 73/41 |
| 4,177,670 | 12/1979 | Heitmann et al. | 73/38 |
| 4,406,156 | 9/1983 | Pezzi | 73/38 |
| 4,860,773 | 8/1989 | Okumoto et al. | 131/281 |
| 4,955,398 | 9/1990 | Milner et al. | 131/280 |

FOREIGN PATENT DOCUMENTS

| | | |
|---|---|---|
| 2258134 | 1/1975 | France . |
| 2332715 | 11/1975 | France . |
| 2371890 | 11/1977 | France . |
| 2474284 | 1/1981 | France . |
| 57-194339 | 11/1982 | Japan . |
| 2098050 | 4/1982 | United Kingdom . |
| 2159284 | 11/1985 | United Kingdom . |

*Primary Examiner*—V. Millin
*Assistant Examiner*—Jennifer Doyle

[57] ABSTRACT

In an apparatus for detecting micro-holes of a cigarette having a filtered section, cigarettes are successively carried to a support section which is rotated and each of the cigarettes is supported between pads 14*a* and 14*b*. The supported cigarette is moved to a pre-pressuring stage in which one end face of the cigarette is closed and a pre-pressure is applied to other end face of the cigarette from a pre-pressure source. Therefore, the cigarette is reached to a measuring stage in which a measuring pressure is applied to the other end face of the cigarette so that air flows through micro-holes of the filter section and a reduced pressure is appeared in the one end of the cigarette. The measuring and reduces pressures are detected by pressure transducers and electrical signals from the transducers are proceed so that dilution value of the cigarette is calculated.

19 Claims, 11 Drawing Sheets

METHOD AND APPARATUS FOR DETECTING MICRO-HOLES OR EXAMINING THE STATE OF MICRO-HOLES FORMED ON EACH OF ROD-LIKE MATTERS

BACKGROUND OF THE INVENTION

1. Field of the Invention

The present invention relates to method and apparatus for detecting or examining the state of micro-holes formed, and more particularly, it relates to a method and apparatus for detecting or examining the state of a plurality of micro-holes formed on the outer circumference of a rod-like object such as a cigarette.

2. Description of the Related Art

Filtered cigarettes give the smoker a lighter taste. Further, some filtered cigarettes have a plurality of micro-holes formed on the outer circumference of each of them so as to dilute smoke flowing through them and decrease the temperature of this smoke. In this type of filtered cigarette, the smoke inhaled into the mouth of the smoker, flows through the cigarette from the tobacco side to the filter side of the cigarette, and is diluted by air sucked into the cigarette through the micro-holes formed on its filter section and through its paper roll.

However, the amount of air sucked into the cigarette through the micro-holes and paper roll must be kept constant in order to provide an enjoyable taste to the smoker. It must be therefore be checked whether or not the amount of air sucked into the cigarette is kept constant. In order to meet this purpose, methods of detecting the amount of air sucked or the dilution of the cigarette have been provided and apparatus for carrying out these methods have also been developed.

Japanese Patent Disclosure Sho 57-194339 discloses one of these methods of detecting the amount of air sucked into the cigarette through the microholes formed on its outer circumference and through its paper roll. In the case of this method, compressed air having a predetermined pressure is supplied into the cigarette from the tobacco side thereof, pressure run out of the cigarette from the filter side thereof is detected by a pressure transducer and the amount or degree of air sucked into the cigarette is calculated on the basis of the pressure detected on the filter side of the cigarette and at the predetermined pressure supplied into the tobacco side the cigarette.

The equation relating to the dilution of the cigarette is generally expressed as follows and a dilution value (D) is calculated using this equation.

$$D=B/A\times 100=(A-C)A/\times 100(\%)$$

where D represents the dilution value of the cigarette, A the amount of air inhaled into the mouth of the smoker, B the amount of air sucked into the cigarette through the outer circumference thereof, and C the amount of smoke inhaled into the mount of the smoker, flowing through the cigarette from the tobacco side thereof.

When this equation is replaced by an equivalent circuit, the following equation is created:

$$D=(P1-P2)/P1\times 100\%$$

wherein P1 represents the predetermined pressure supplied into the cigarette and P2 the pressure run out of the cigarette and detected.

In the case of the conventional methods of detecting the amount of air supplied into the cigarette, the pressure run out of the cigarette is detected only on the filter side of the cigarette. The pressure supplied into the cigarette is not detected on the tobacco side of the cigarette but the dilution value (D) is detected because the predetermined pressure is usually applied into the cigarette from the tabacco side thereof. When a time period long enough to keep the pressure in the cigarette at the value of that pressure which is supplied into the cigarette from the tobacco side exists, a sufficiently accurate dilution value (D) of the cigarette can be detected. In the case where this dilution measuring method is employed in the manufacturing process of carrying the cigarettes at relatively low speed, the dilution values can be relatively accurately measured.

However, the cigarettes are now carried at high speed in the manufacturing process so as to enhance productivity. This results in the pressure run out of the cigarette being detected before the pressure in the cigarette reaches the value of that pressure which is supplied into the cigarette, thereby making it impossible for the dilution to be accurately detected. Namely, when the speed at which the cigarettes whose dilution is to be detected are carried is higher than the speed at which the detecting pressure reaches the filter end of the cigarette through the tabacco end thereof, the pressure run out of the cigarette cannot be detected with the same accuracy as in the case where the cigarettes are carried at low speed, because the cigarette is shifted out before the detecting pressure reaches the filter end of the cigarette from the tobacco end thereof. Detection accuracy therefore is very low.

In the case of the conventional detector apparatuses, micropressure is obtained by increasing the pressure through an orifice and calculating the flow rate of this increased pressure, but pressure detection after this pressure increasing process causes its accuracy to be very low also.

SUMMARY OF THE INVENTION

The present invention therefore eliminates the above-mentioned drawbacks.

Accordingly, the object of the present invention is to provide a method and apparatus capable of detecting the amount of air sucked into a cigarette and the dilution of the cigarette with higher accuracy even when the cigarettes are carried at high speed.

According to the present invention, there is provided a method of detecting or examining the state of micro-holes formed on a rod-like object comprising a step of applying pre-pressure to the rod-like object through on end of the object while keeping the other end of the object closed; a step of adding measuring pressure to the rod-like object, to which the pre-prepressure has been applied, through one end of the object, detecting the measuring pressure and converting it to a first electric signal and detecting pressure run through the outer end of the rod-like object to and converting it to a second electric signal; and a step of processing the first and second electric signals to arithmetically calculate the dilution of the rod-like object.

According to the present invention, there is also provided an apparatus for detecting or examining the state of micro-holes formed on a rod-like object comprising a means for carrying the micro-holes-formed rod-like object; means for applying pre-pressure to the carried rod-like objects trough one end thereof while keeping the other end of the rod-like object closed; means for adding measuring pressure to the rod like object, to which the pre-pressure has been applied, through one end of the object; first detector means for detecting the measuring pressure applied to the rod-like matter to convert it to a first electric signal; second detector means for detecting the pressure run out of the other end of the rod-like object to which the measuring pressure has been applied and converting it to a second electric signal; and means for processing the first and second electric signals to arithmetically calculate the dilution of the rod-like object.

According to the present invention, the prepressure is previously applied to the rod-like object. Even if this rod-like object is carried at high speed, therefore, the measuring pressure can be reliably applied to the rod-like object. In addition, both the measuring pressure measuring to the rod-like object and the pressure run out of the rod-like object can be directly detected to thereby increase detection accuracy.

Further, the pressures measured can be directly converted to electric signals by converters and this enables the detection accuracy to be increased over the systems which use orifices and the like is to increase pressure.

Further scope of applicability of the present invention will become apparent from the detailed description given hereinafter. However, it should be understood that the detailed description and specific examples, while indicating preferred embodiments of the invention, are given by way of illustration only, since various changes and modifications within spirit and scope of the invention will become apparent to those skilled in the art from this detailed description.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An example of the apparatus for examining the state of micro-holes according to the present invention will be described with reference to the accompanying drawings.

Figure 1:
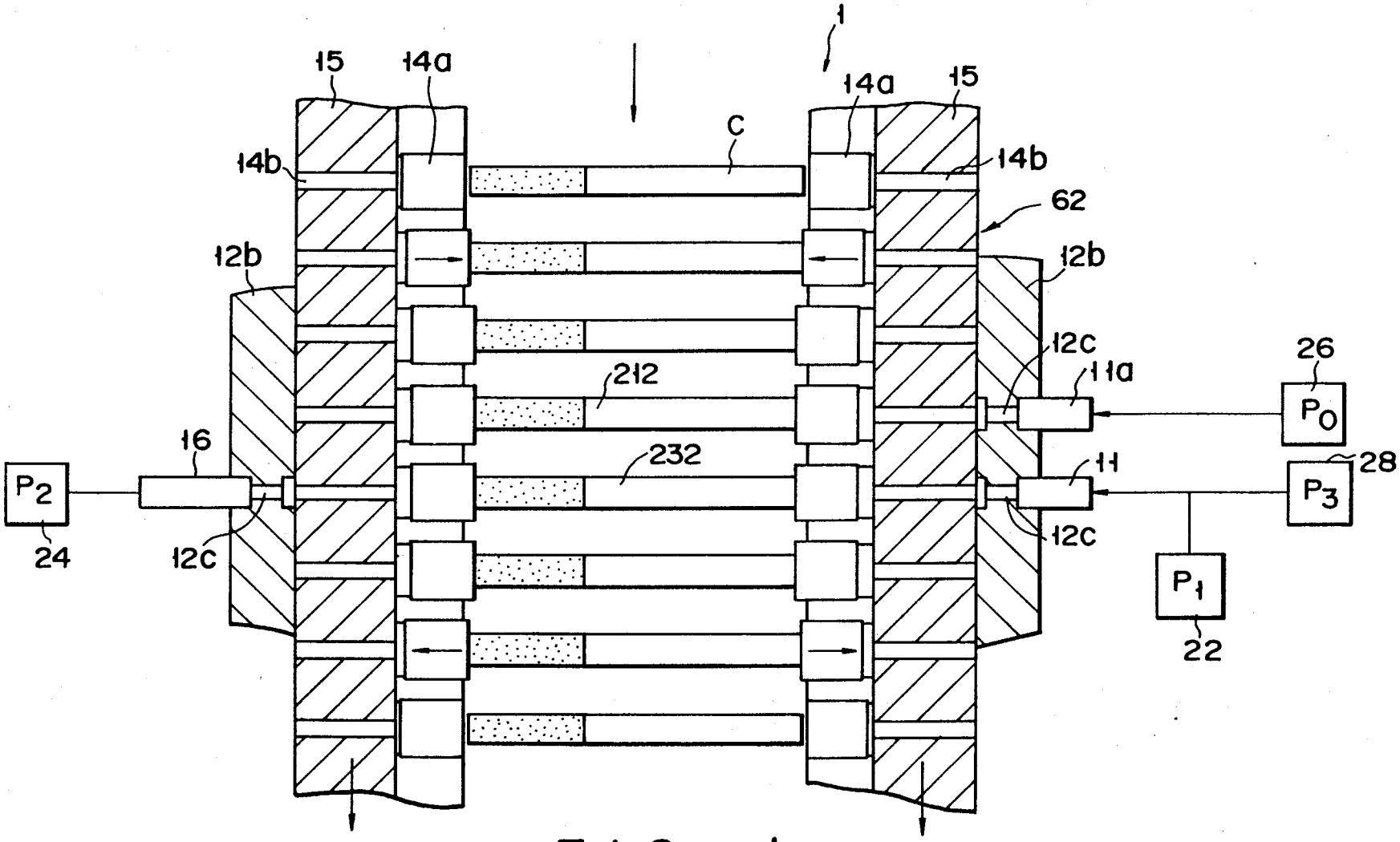
FIG. 1 is a sectional view showing the main portion of the apparatus for examining the state of micro-holes formed at the filter section of each rod-like object according to the present invention.
Figure 2:
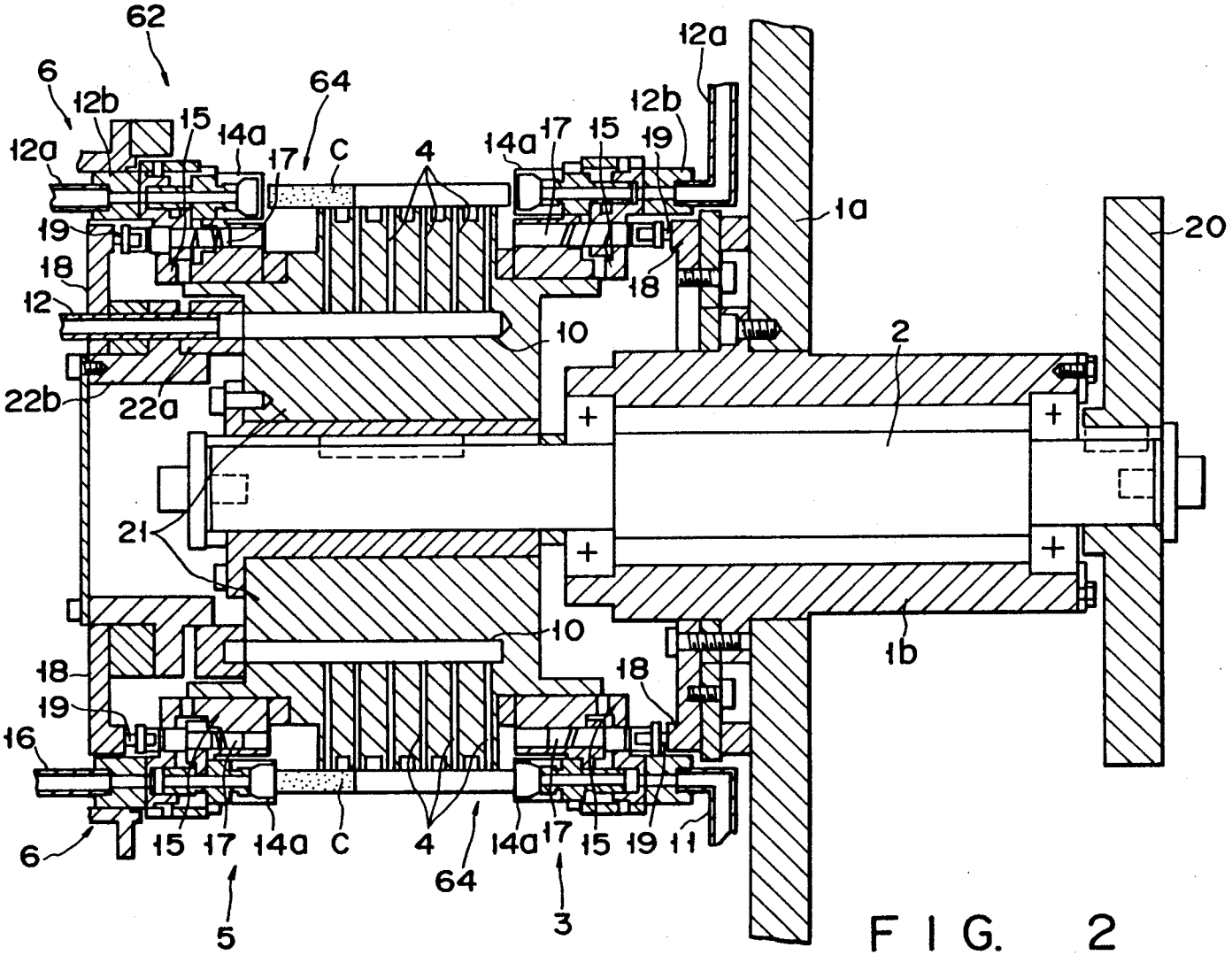
FIG. 2 is a sectional view showing the entire apparatus of FIG. 1.
Figure 3:
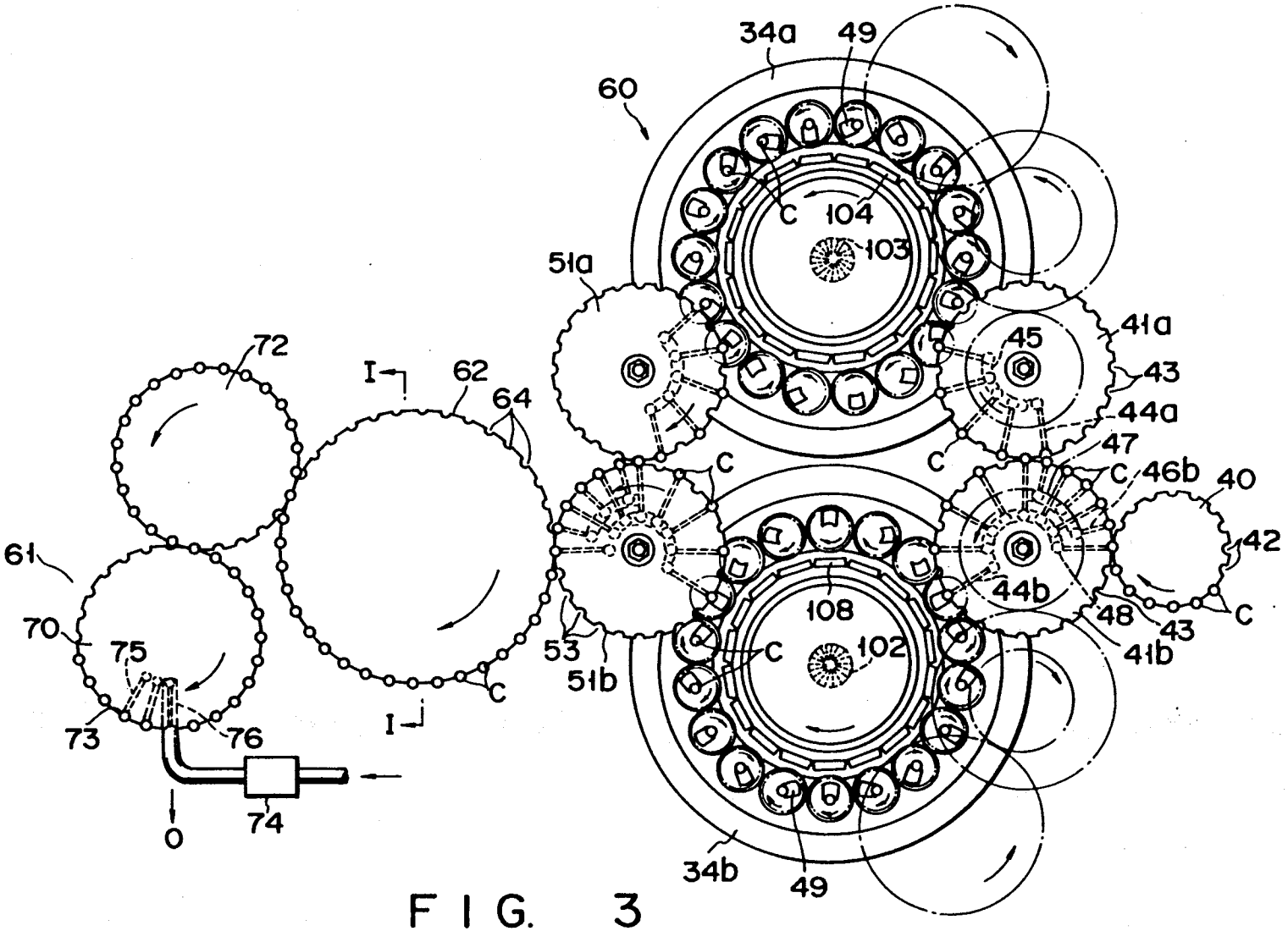
FIG. 3 is a front view showing a micro-hole forming apparatus into which the micro-hole examining apparatus in FIG. 2 is incorporated.

FIG. 1 is a sectional view showing the main portion of the apparatus for examining the state of micro-holes according to the present invention, FIG. 2 is a sectional view showing the entire microhole examining apparatus in FIG. 1, and FIG. 3 is a plan showing a micro-hole forming apparatus into which the micro-hole examining apparatus in FIG. 2 is incorporated.

Micro-holes are formed at the filter paper of the filter section of each of filtered cigarettes by a micro-hole forming apparatus 60 shown in FIG. 3 before the process of examining the state of the micro-holes or dilution of each of the filtered cigarettes is begun. The cigarettes with micro-holes in the filter section are conveyed to a dilution examining apparatus 1 shown in FIGS. 1 and 2, by which the amount of air introduced into each of the filtered cigarettes (or dilution) is examined. In other words, the micro-holes formed at the filter section of each of the filtered cigarettes C are examined.

The micro-hole forming apparatus shown in FIG. 3 includes disks 34*a* and 34*b* for forming micro-holes at the filter section of each of the cigarettes C conveyed at high speed, and substantially cone-shaped polyhedron mirrors 102 and 103 which rotate together with the disks 31*a* and 34*b* are attached to rotating shafts of these disks 34*a* and 34*b*. A plurality of focusing lenses 104 are arranged on a circle round the rotating shaft of the disk 34*a* and fixed to the disk 34*a*, opposing to their corresponding reflecting faces of the polyhedron mirror 103, and a plurality of focusing lenses 108 are also arranged on a circle round the rotating shaft of the disk 34*b* and fixed there, opposing to their corresponding reflecting faces of the polyhedron mirror 102. Pulse laser beams generated intermittently and introduced to the polyhedron mirrors 102 and 103 through optical systems (not shown) are reflected and divided by the reflecting faces of these polyhedron mirrors 102 and 103 into a plurality of beams, which are focused through the focusing lenses 104 and 108 onto the outer circumference of each of the cigarettes C held by the disks 34*a* and 34*b*. The micro-holes are thus formed on the outer circumference of each of the cigarettes C.

A roller 40 and first and second intermediate rollers 41*a* and 41*b* which cooperate with the roller 40 to intermittently supply the cigarettes C to the disks 34*a* and 34*b* are arranged adjacent to the disks 34*a* and 34*b*. The roller 40 is shaped like a column and provided with a plurality of holder grooves 42 on the outer circumference thereof. The second intermediate roller 41*b* is closely located between the roller 40 and the second disk 34*b*, and the first intermediate roller 41*a* is also closely located between the second intermediate roller 41*b* and the first disk 34*a*. These disks 34*a*, 34*b*, intermediate rollers 41*a*, 41*b* and roller 40 are rotated at a same circumferential speed by a drive system (not shown).

Each of the intermediate rollers 41*a* and 41*b* has a plurality of holder grooves 43, shaped substantially semi-circular in section, on the outer circumference thereof and the interval of the holder groove 43 relative to its adjacent ones in the circumferential direction of each of the intermediate rollers 41*a* and 41*b* is made equal to the interval between the holder grooves 42 on the roller 40 and also set half the interval between holder arms 49 on each of the disks 34*a* and 34*b*. Plural sucking holes (not shown) are formed at the bottom of each of the even holder grooves 43 on the first intermediate roller 41*a* and these holder grooves 43 are connected with vacuum passages 44*a* through the sucking holes. These vacuum passage 44*a* are connected to a vacuum system through a circular communicating groove 45.

Similarly, sucking holes are formed at the bottom of each of the odd holder grooves 43 on the second intermediate roller 41*b* and these uneven holder grooves 43 are connected with vacuum passages 44*b* through the sucking holes. These vacuum passages 44*b* are connected to a vacuum system through a circular communicating groove 48. Further, sucking holes are formed at the bottom of each of the even holder grooves 43 on the second intermediate roller 41*b* and these even holder grooves 43 are connected to with vacuum passages 46*b* through the sucking holes. These vacuum passages 46*b* are connected to a vacuum system through a circular communicating groove 47 which is different from the communicating groove 48.

The communicating groove 45 in the first intermediate roller 41*a* extends from a position at which the first intermediate roller 41*a* is closed to the second intermediate roller 41*b* to a position at which the first intermediate roller 41*a* is closed to the first disk 4*a*. The communicating groove 48 in the second intermediate roller 41*b* extends from a position at which the second intermediate roller 41*b* is closed to the roller 40 to a position at which the second intermediate roller 41*b* is closed to the second disk 34*b* and the communicating groove 47 in the second intermediate roller 41*b* extends from a position at which the second intermediate roller 41*b* approaches the roller 40 to a position at which the second intermediate roller 41*b* approaches the first intermediate roller 41*a*.

Since the micro-hole forming apparatus has the above-described arrangement, the cigarettes C fed from the previous process in the course of manufacturing the cigarettes are received, held and conveyed in the holder grooves 42 on the rotating roller 40. When the cigarettes C in the holder grooves 42 on the rotating roller 40 come near to the second intermediate roller 41*b*, they are transferred into the holder grooves 433 on the second intermediate roller 41*b*. The cigarettes C thus transferred are sucked and held in the holder grooves 43 on the second intermediate roller 41*b* and carried by the rotating second intermediate roller 41*b*. The communicating groove 47 communicated with the even holder grooves 43 extends only from the position at which the second intermediate roller 41*b* is close to the supply roller 40 to the position at which the second intermediate roller 41*b* is close to the first intermediate one 41*a*. When one of the even holder grooves 43 on the second intermediate roller 41*b* moves to the position at which both of the first and second intermediate rollers 41*a* and 41*b* are close to each other, therefore, the cigarette C sucked and held in this groove is released from the groove and transferred into the even holder groove 43 on the first intermediate roller 41*a*. The cigarette C thus transferred is held and carried by the first intermediate roller 41*a*. When the cigarette C is moved to the position at which the first intermediate roller 41*a* is close to the first disk 34*a*, it is transferred to the holder arm 49 of the first disk 34*a*. The cigarettes in the even holder grooves 43 on the first intermediate roller 41*a* are thus successively transferred to the holder arms 49 of the first disk 34*a*.

On the other hand, the cigarettes held in the uneven holder grooves 43 on the second intermediate roller 41*b* are carried by the second intermediate roller 41*b* even after they pass the position at which the first and second intermediate rollers 41*a* and 41*b* are close to each other. When the first one of them is moved to the position at which the second intermediate roller 41*b* is close to the second disk 34*b*, it is transferred to the holder arm 49 of the second disk 34*b*. They are thus successively transferred to the holder arms 49 of the second disk 34*b*.

The cigarettes supplied from the roller 40 are divided by the intermediate rollers 41*a* and 41*b* into even and uneven groups and the cigarettes belonging to the even group are transferred to the holder arms 49 of the first disk 34*a* while those belonging to the uneven group to the holder arms 49 of the second disk 34*b*.

The holder arms 49 of the first and second disks 34*a* and 34*b* are rotated by a drive system (not shown). Therefore, the holder arms 49 are rotated round the rotating shafts of the disks 34*a* and 34*b*, while rotating on their axes. Micro-holes are thus formed at the outer circumferences of the cigarettes C by the pulse laser beam reflected by the polyhedron mirrors 102 and 103 and focused onto the cigarettes C.

First and second discharge rollers 51*a* and 51*b* are located symmetrical to the intermediate rollers 41*a* and 41*b* with the first and second disks 34*a* and 34*b* interposed between them, that is, they are located on the discharge side of the micro-hole forming apparatus. They have holder grooves 53 and vacuum passages which are substantially same in arrangement as those of the intermediate rollers 41*a* and 41*b*. Description of their holder grooves 53 and vacuum passages will be omitted accordingly, but they are different from the intermediate rollers 41*a* and 41*b* in that they are rotated in a direction reverse to the direction in which the intermediate rollers 41*a* and 41*b* are rotated.

A dilution examining apparatus which will be described later is located on the discharge side of the intermediate discharge rollers 51*a* and 51*b*, contacting the intermediate discharge roller 51*b*. A dilution drum 62 has such an arrangement as shown in FIGS. 1 and 2. This dilution drum 62 and the intermediate discharge roller 51*b* have a plurality of holder grooves 53 and 64, each shaped like a semicircle in section, on outer circumferences thereof and the holder grooves 53 on the dilution drum 62 are arranged at a same interval as those on the intermediate discharge roller 51*b*. The even cigarettes are therefore transformed from the first disk 34*a* to the first discharge roller 51*a* and then to the second discharge roller 51*b*, while the odd cigarettes are transferred from the second disk 34*b* to the second discharge roller 51*b*. All of the cigarettes held by the second discharge roller 51*b* are then successively transferred into the holder grooves 64 on the dilution drum 62.

Further, a system 61 for eliminating defecting cigarettes is arranged in close proximity to the dilution drum 62. This eliminator system 61 comprises an eliminating drum 70 and a carriage roller 72 which is close to the eliminating drum 70 and the dilution drum 62.

The discharge side of the micro-hole forming apparatus has the above-described arrangement. The cigarettes C on each of which the mciro-holes have been formed are carried from the holder arms 49 of the first and second disks 34*a* and 34*b* to the intermediate discharge rollers 51*a* and 51*b* and then to the dilution drum 62 where the amount of air introduced into each of the cigarettes will be measured as described later. The cigarettes C which have been thus measured are carried to the eliminating drum 70 through the carriage roller 72.

As seen in the case of the intermediate supply and discharge rollers 41*a*, 41*b*, 51*a* and 51*b*, the eliminating roller 70 has sucking passages 75 connected to a sucking pump (not show), and sucking holes (not shown) communicated with the sucking passages, and the cigarettes C are sucked and carried in holder grooves 73 on the eliminating roller 70. If one of the cigarettes is defective or its roll paper is not good or its dilution value is extremely large, a valve system 74 interposed between the sucking pump and the sucking passages 75 is made operative. When this valve system 74 is made operative, compressed air is supplied from an air supply pump (not shown) into the sucking passage 75 though a blow pipe 76. The pressure of the air supplied into the blow pipe 76 is larger than sucking force added to the cigarette which is sucked and held int the holder groove 73 on the eliminating drum 70 through the sucking passage 75 by the sucking pump. The defective cigarette C is thus released from its being sucked in the holder groove and eliminated from the eliminating drum 70.

As shown in FIG. 2, the dilution drum 60 includes a bearing section 1*b* fixed to a base 1*a*, and a shaft 2 rotatably held in the bearing section 1. A gear 20 to which rotating force is added from another gear (not shown) is fixed to one end of the rotating shaft 2 and a rotary section 21 shaped like a column is fixed to the other end of the rotating shaft 2. A vacuum passage 10 is formed like a ring in the rotary section 21. Pipe fixing sections 22*a* and 22*b* to which a pipe 12 for transmitting sucking pressure to the vacuum passage 10 is fixed are fixed to the vacuum passage 10. The vacuum passage 10 is opened in the pipe fixing section 22*a* and communicated with a hole which is communicated with the pipe 12, and the opened end of the vacuum passage 10 is airtightly contacted with an opened end of the communicating hole in the pipe fixing section 22*a*. Even when the rotary section 21 is rotated, therefore, sucking force added through the pipe 12 can be reliably transmitted to the vacuum passage 10 in the rotary section 21. A plurality of communicating grooves 4 radially extended in the rotary section 21 and communicated with the vacuum passage 10 and the holder grooves 64 on the outer circumference of the rotary section 21 are formed in the rotary section 21. When the cigarettes C are transferred from the discharge roller 51*b* into the holder grooves 64, therefore, they are held thereby the sucking force transmitted through the vacuum passage 10 and the communicating grooves 4. The rotary section 21 is further provided with a push rod system 6 which is fixed to and rotated together with the rotary section 21.

Figure 4:
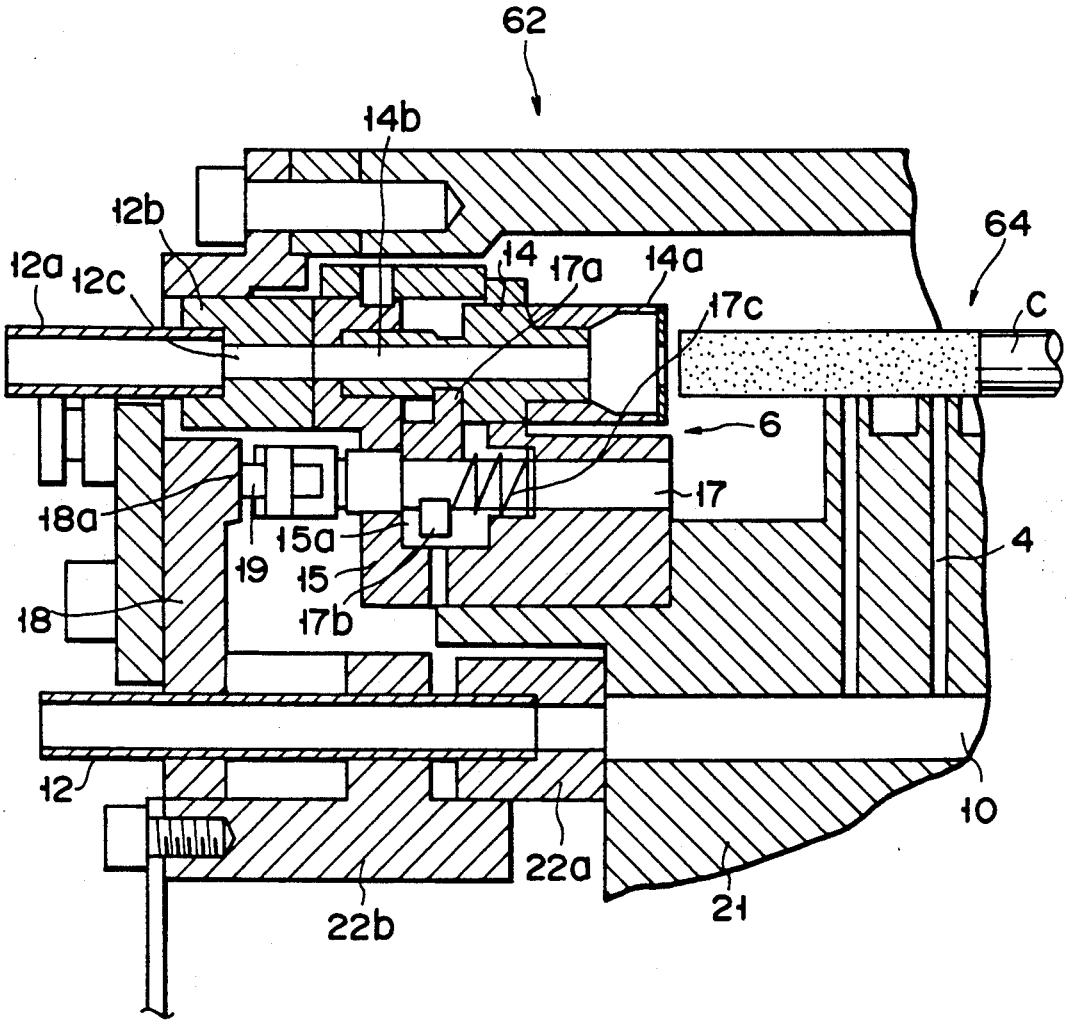
FIG. 4 is a sectional view showing a part of the micro-hole examining apparatus in FIG. 2.

As shown in FIG. 4, the push rod system 6 includes a support section 15 which supports a push rod 17 movable in the longitudinal direction of the rod and which is fixed to and rotated together with the rotary section 21. As shown in FIG. 4, a roller system 19 is attached to one end of the push rod 17 and the roller of this roller system 19 is contacted with a cam face 18*a* of a fixing section 18, which is fixed to the pipe fixing section 22*a*, in such a way that it can rotate on the cam face 18 while rotating together with the rotary section 21. As will be described later, the cam face 18*a* becomes gradually higher and higher and the highest at a predetermined position. A hollow portion 15*a* is formed in the support section 15, and a push bar 17*a* is located in a sliding groove in the hollow portion 15*a* and fixed to the push rod 17 by a pin 17*b*. A bias spring 17*c* which is fixed to the pin 17*b* and contacted with the inner face of the hollow portion 15*a* is arranged round the push rod 17 to urge the push rod 17 in the backward direction so as to contact the roller of the roller system 19 with the cam face 18*a*.

A pad block 14 is further supported in a support section 15 to move in a direction nearly parallel to the direction in which the push rod 17 is pushed, and the push bar 17*a* is struck against a stepped portion of the pad block 14. A hole 14*b* which is connected with an open end of a pad 14*a* is formed in the pad block 14. That face of the support section 15 at which an open end of the communicating hole 14*b* located in opposite to the pad 14*a* terminates is air-tightly struck against a face of a fixing support section 12*b* by which a cleaning pipe 12*a* is supported. An open end of a hole 12*c* which is communicated with the cleaning pipe 12*a* terminates at this face of the support section 12*b*. Before the cigarettes C are transferred into the holder grooves 64 on the dilution drum 62, the pad 14*a* is cleaned by cleaning air supplied through the cleaning pipe 12*a*, communicating hole 12*c* and communicating hole 14*b* in the support section 15.

As apparent from FIG. 2, the push rod system 6 and parts related to this push rod system 6 which are located on the tabacco side of the cigarette C are same in arrangement as those located on the filter side of the cigarette C as shown in FIG. 4. As shown at the lower portion of FIG. 2, the push rod system 6 and parts related to the push rod system 6 including a structure 4 for supplying measuring pressure into the cigarette C from the tobacco side thereof and another structure 5 for escaping the pressure out of the cigarette C from the filter side thereof are same in arrangement as those located on the filter side of the cigarette C and shown in FIG. 4. However, those pipes of the pressure supplying and escaping structures 3 and 5 which serve as pressure supplying and escaping pipes for allowing the pressure to enter the escape therethrough are denoted by reference numerals 11 and 16 which are different from those in FIG. 4.

The dilution drum 62 has the above-described arrangement. Therefore, the cigarettes C supplied from the intermediate discharge roller 51*b* are held in the holder grooves 64 by suction and carried to the pressure supplying and escaping structures 3 and 5 shown at the lower portion of FIG. 2, while rotating round the dilution drum 62 as the rotary section 21 rotates. When the cigarette C is carried in this manner, the roller of the roller system 19 rotates on the cam face 18*a* of the fixing section 18. As the roller of the roller system 19 rotates on the cam face 18*a*, the cam face 18*a* becomes higher and higher to push the roller forward. The push rod 17 is thus pushed in the longitudinal direction against the bias spring 17*c* and the push bar 17 advances the pad block 14. When the pads 14*a* opposed to each other and located on the filter and tabacco sides of the cigarette C advance to each other, the interval between these opposed pads 14*a* becomes narrower to hold the cigarette C between the paired opposed pads 14*a*. The paired pads 14*a* are thus communicated with each other through the cigarette C, which is made ready for dilution measurement.

After the dilution measurement of the cigarette C is finished, the paired pads 14*a* are retreated from each other because the cam face 18*a* becomes lower and lower. The cigarette C is thus released from between the paired pads 14*a*. When the cigarette C is further carried as the rotary section 21 rotates, sucking force applied to the holder groove 64 becomes inoperative to thereby transfer the cigarette C to the carrier roller 72.

The dilution measurement relative to the cigarette C on the dilution drum 62 will be described referring to FIG. 1. As already described above, the micro-hole formed cigarette C on the dilution drum 62 is positioned between the pads 14*a* while being sucked and held in the holder groove 64 on the dilution drum 62. When the dilution drum 62 rotates a little further, the cigarette C is held between the pads 14*a*. As the support sections 15 rotate after the cigarette C is held between the pads 14*a*, these support sections 15 move to that area of the fixing support section 12*b* which is located on the filter side of the cigarette and provided with no communicating hole 12*c*. When the cigarette C is carried to a position 212 under this state, prepressure PO is added from a prepressure pipe 11*a* to the cigarette C through the communicating holes 12*c* and 14*b*. The communicating hole 14*b* in the rotating support section 15 is closed this time by the fixing support section 12*b* is located on the filter side of the cigarette. Therefore, compressed air PO is applied from a pre-pressure source 26 to the tobacco side of the cigarette C, then into the cigarette C itself through a pre-pressure supply pipe 11*a*, communicating hole 14*b* and pad 14*a* under the condition that the communicating hole 14*b* in the support section 15 located on the filter side of the cigarette is closed by the fixing support section 12*b* also located on the filter side of the cigarette. As a result, internal pressure in the cigarette C is thus previously increased.

When the cigarette C which is moved under this prepressure applied reaches a position 232, it is communicated with the pads 14*a*, communicating holes 14*b*, 12*c* and a pre-pressure escaping pipe 16 which are located on the filter side of the cigarette. Compressed air P3 which serves as measuring pressure is added from a measuring pressure source 28 to the tobacco side of the cigarette C through the communicating holes 12*c*, 14*b* and pad 14*a* which is located on the tobacco side of the cigarette. Pressure in the cigarette C reaches a pressure transducer 24 this time, passing through the cigarette itself, communicating holes 14*b*, 12*c*, pad 14*a*, communicating holes 14*b*, 12*c* and pipe 16, and pressure value P2 which is reduced by air flowing through the micro-holes at the filter section of the cigarette C is detected by the pressure transducer 24. Measuring pressure P1 and the reduced pressure value P2 are converted to electric signals by pressure transducers 22 and 24, respectfully. Dilution relative to the cigarette C is calculated on the basis of these signals and it is found whether or not the micro-holes of the cigarette C are within a standard, as will be described later. When this measurement relative to the cigarette C is finished, the cigarette C is carried by the rotating dilution drum 62 and transferred to the eliminating drum 70 via the carriage roller 72.

Figure 5:
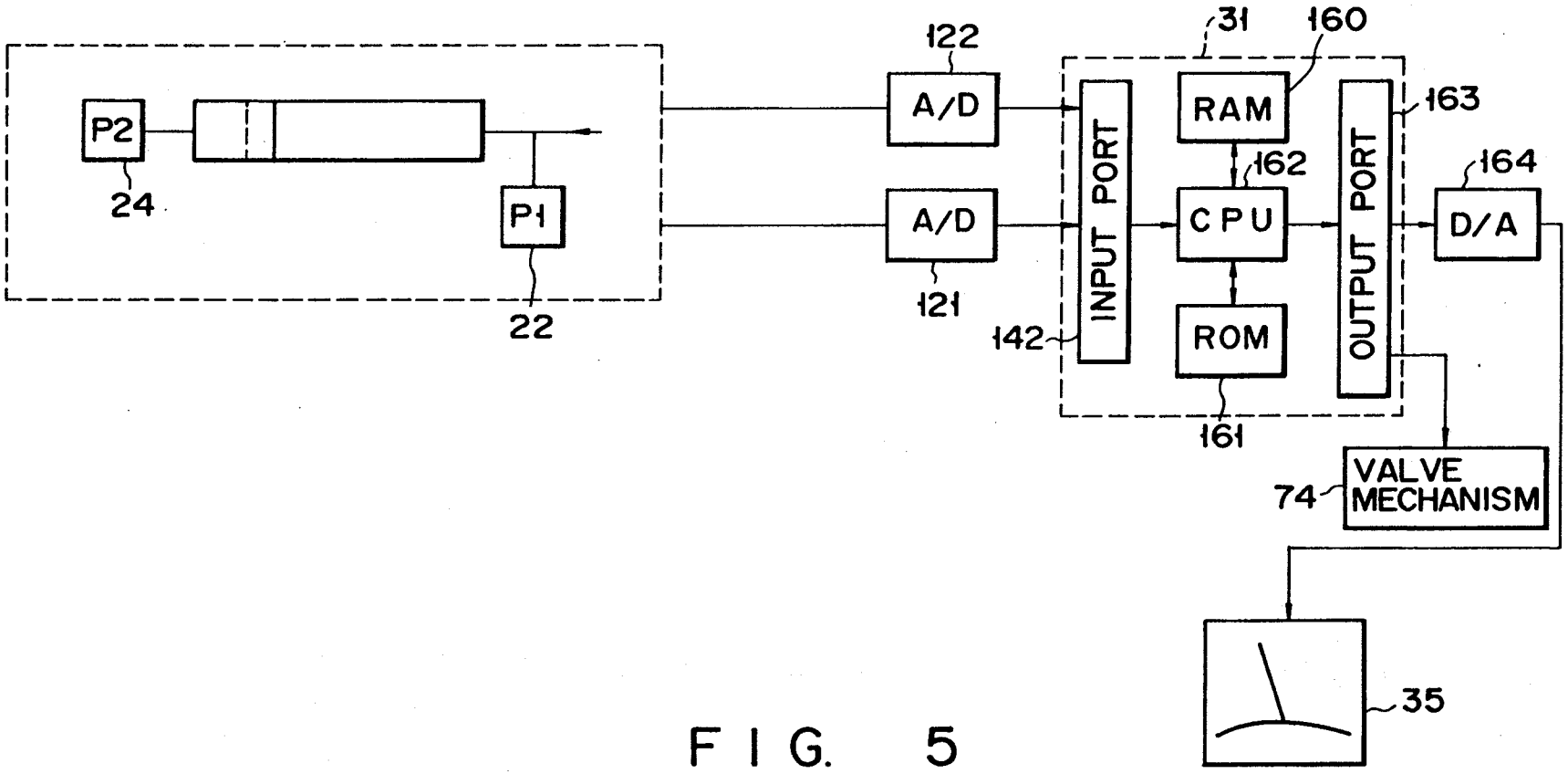
FIG. 5 is a block diagram showing an arithmetic section of the micro-hole examining apparatus in FIGS. 1 and 2.
Figure 6:
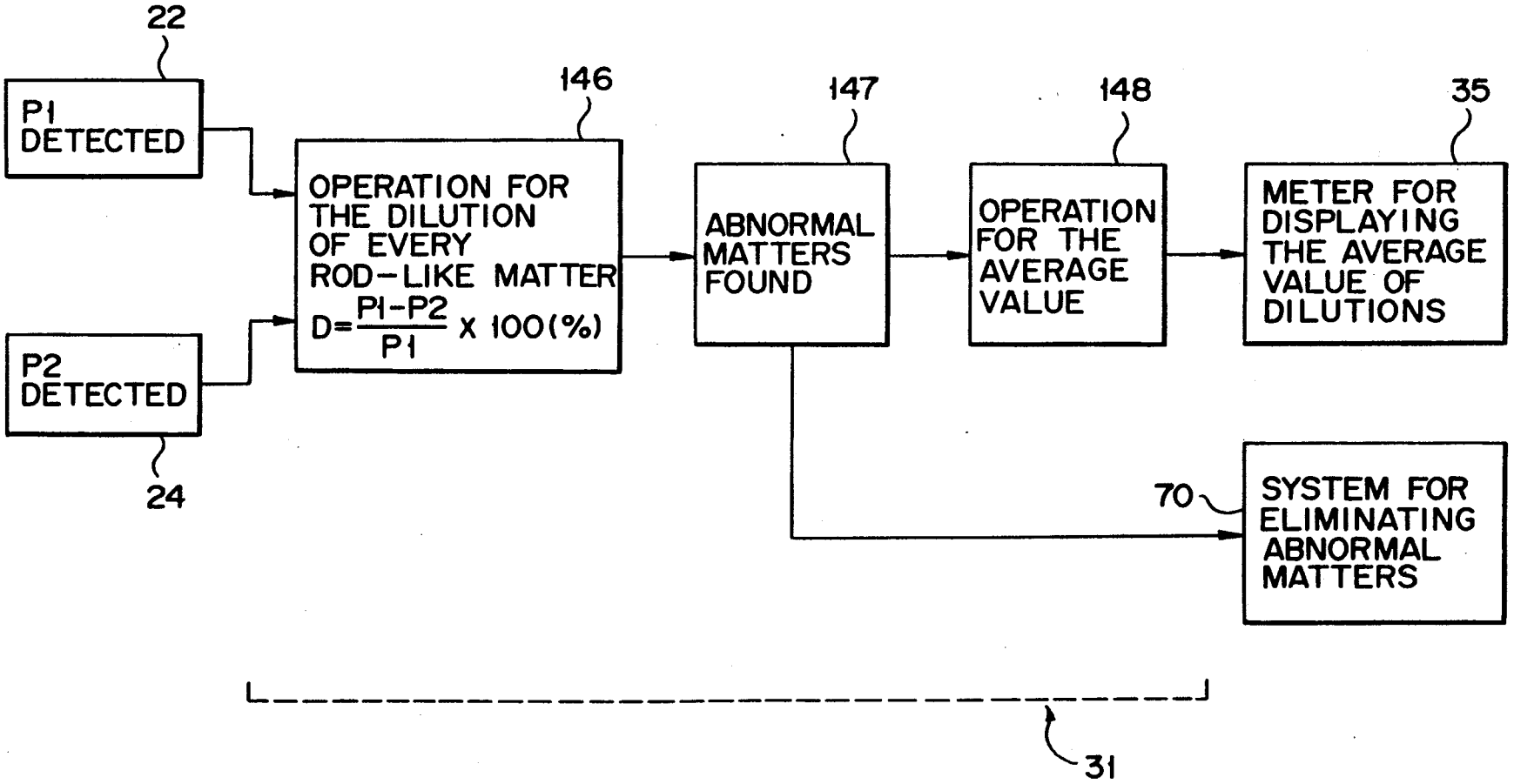
FIG. 6 is a block diagram showing the function of the arithmetic section in FIG. 5.

The measuring compressed air P1 and detected pressure P2 measured by the pressure transducers 22 and 24 are converted to electric signals by the pressure transducers 22 and 24,. As shown in FIG. 5, the signals are converted to binary by A/D converters 121 and 122 and inputted to a dilution operational section 31 through an input circuitry 142 of a control circuit. The dilution operational section 31 comprises a CPU 162, using an operation formula stored in the ROM 161. Results thus calculated are successively input to the RAM 160 shown in FIG. 5 When a dilution which represents a defective cigarette is detected from the results measured at a section shown by a reference numeral 147 in FIG. 6, a command representing that the cigarette is defective is applied from the CPU 162 to an output section 163 and the valve mechanism 74 of the eliminator system 67 is made operative by the command to eliminate the cigarette C from the eliminating drum 70. When an abnormally large or small dilution is detected, for example, the defective cigarette whose paper roll is not good or whose micro-holes are not formed yet is eliminated from the eliminating drum 70. Further, after a predetermined number of data are collected as shown in FIG. 6, an average value of the dilutions relating to the cigarettes C at the filter sections of which the micro-holes have been formed by the disks 34*a* and 43*b* is calculated at a section denoted by a reference numeral 148. Namely, the dilution of every cigarette C is calculated in the CPU 162, using the operational formula stored in the ROM 161 and results thus calculated are inputted to the RAM 160 shown in FIG. 5. The average value is converted to an analog signal by a D/A converter 164 through the output section 163 and outputted to a display section 35 where the average value is displayed.

Figure 7A:
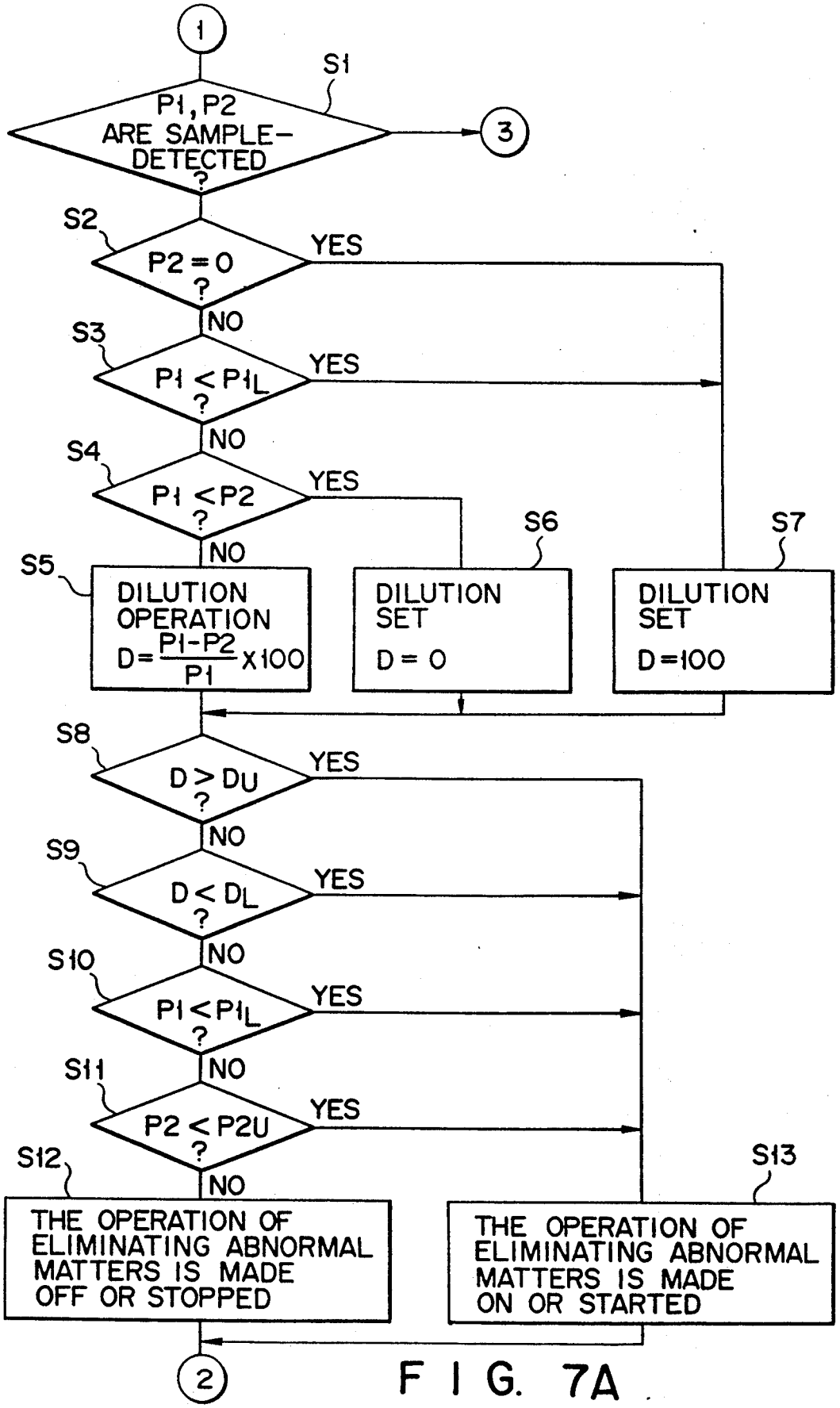
FIG. 7A and 7B are flow charts showing how the arithmetic section in FIG. 5 functions.
Figure 7B:
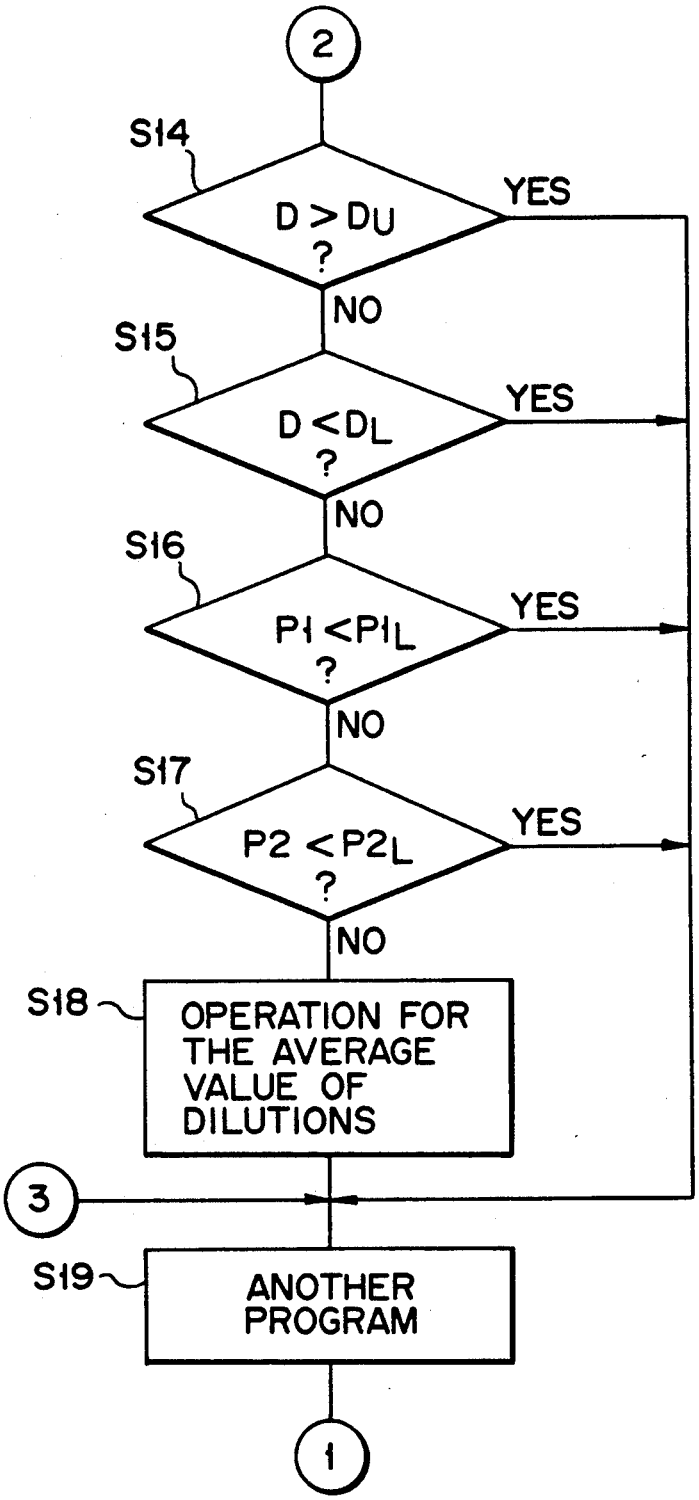

The operational detection of the dilution operational section 31 will be described in more detail referring to a flow chart shown in FIGS. 7(A) and 7(B). As described above, compressed air is supplied twice, as the pre-pressure PO and the detecting pressure P3, to the cigarette C from the tobacco side thereof. When the detecting pressure P3 is supplied to the cigarette C, therefore, it is checked at a step S1 whether or not the pressures P1 and P2 are detected on the tobacco and filter side of the cigarette C by the pressure detectors 22 and 24. When pressures P1 and P2 are not detected, they are sample-detected according to another program at a step S19. When they are detected and $P2=0$ at a step S2, it is checked at a step S3 whether or not $P1<P1L$ (wherein P1L denotes the lower limit level of the pressure P1 which can be measured on the tobacco side of the cigarette) or, in other words, it is checked at a step S3 whether or not P1 is smaller than its lower limit level. When the answer is not, it is checked at a step S4 whether or not $P1<P2$. When the answer is no, a dilution value D is detected at a step S5 using a dilution operational formula which will be cited later.

When $P2=0$ at the step S2, it is set at a step S7 that the dilution value $D=100$. When the pressure P1 on the tobacco side of the cigarette is smaller than its lower limit level P1L at the step S3, it is similarly set at the step S7 that the dilution value $D=100$. When the pressure P1 on the tobacco side of the cigarette is greater than the pressure P2 on the filter side of the cigarette and abnormality is caused in the measurement, it is set at a step S6 that the dilution value $D=0$.

It is checked at a step S8 whether or not dilution values D detected at the steps S5, S6 and S7 are larger than DU (wherein DU represents the upper limit level of the dilution). When the dilution value does not exceed its upper limit level DU, it is further checked at a step S9 whether or not $D<DL$ (wherein DL denotes the lower limit level of the dilution value). When the dilution value D is not smaller than its lower limit level DL, it is checked at a step S10 whether or not P1<P1L. When the answer is no, it is checked at a step S11 whether or not P2<P2L (wherein P2L represents the lower limit level of the pressure P2 on the filter side of the cigarette) or whether or not the pressure P2 on the filter side of the cigarette exceeds its lower limit level P2L. When the answer is no, the operation of eliminating abnormal cigarettes is stopped at step S12 and the cigarette is carried as a normal one to a next process.

When the answer is yes at the steps S8, S9, S10 and S11, the operation of eliminating abnormal cigarettes is started and the cigarette is eliminated by the eliminator system 67.

The dilution values D detected at the above-mentioned steps are processed as follows to obtain the average value of these dilution values. It is checked at a step S14 whether or not D is larger than the upper limit level of the dilution value. When the answer is no, it is checked at a step S15 whether or not D is smaller than the lower limit of the dilution value. When the answer is no, it is checked at a step S16 whether or not P1<P1L. When the answer is no, it is checked at a step S17 whether or not P2<P2L. When the answer is no, the operation of dilution average value is carried out at a step S18 as will be described later. This average value follows a flow of the another program at step S19 and it is displayed by a dilution average value display meter 35.

When the answer is yes at the steps S14, S15, S16 and S17, another program at step S19 is used to process the value detected.

The principle of the above-described dilution detecting method will be described referring FIGS. 8A and 8B.

The dilution operational formula is expressed as follows:

D=B/A−(A−C)/A wherein A represents the amount of C+B or amount of air inhaled into the mouth of the smoker, C the amount of air sucked into the cigarette through the front end of the cigarette, and B the amount of air sucked into the cigarette through the outer circumference of the cigarette.

Figure 8B:
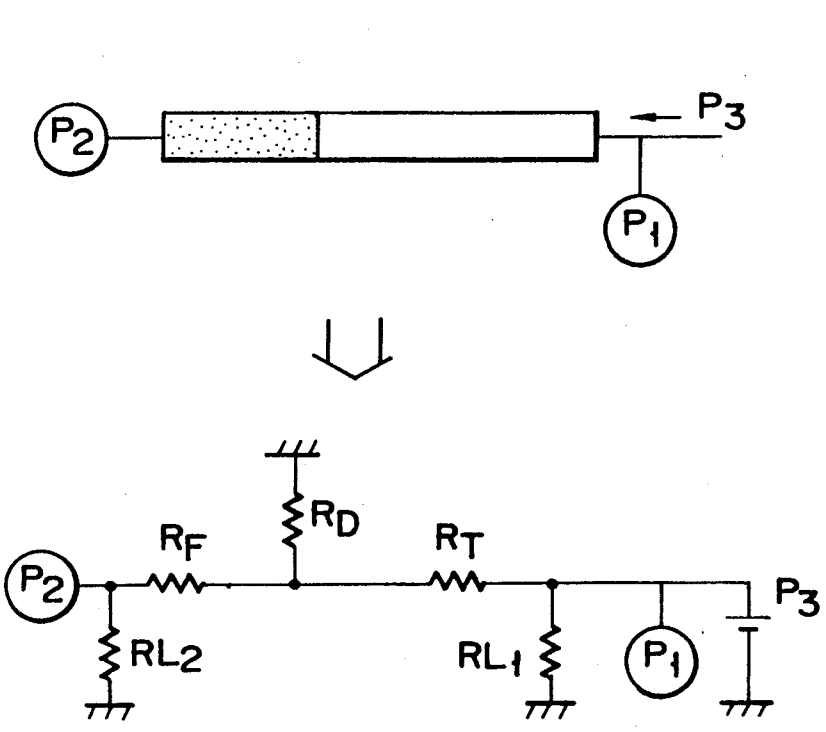
FIGS. 8A and 8B show equivalent circuits intended to explain the principles of a method for detecting dilution.
Figure 8A:
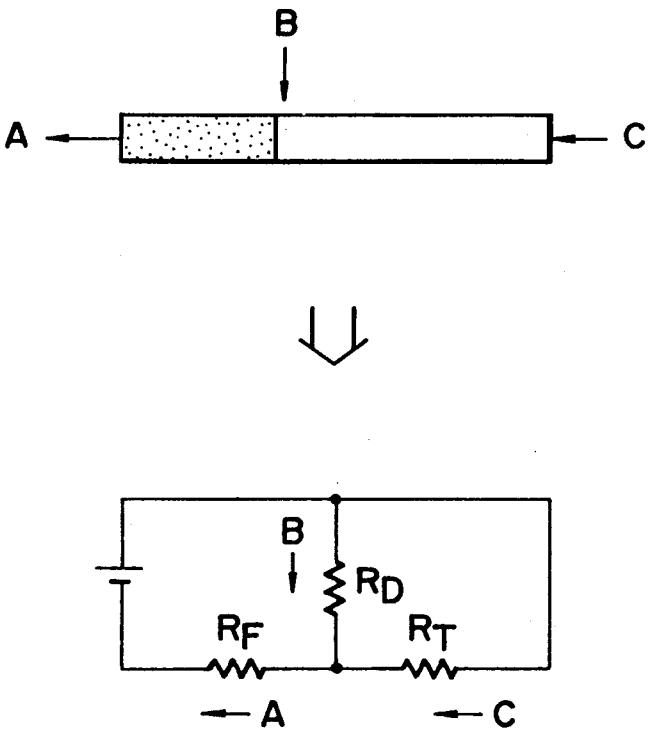

When ventilating resistance added to the cigarette is replaced by such an electric equivalent circuit as shown in FIG. 8A.

$$D=RT/(RD+RT).$$

When two pressure sensors connected as shown in FIG. 8B are used, an equivalent resistance which corresponds to the ventilating resistance on the upstream side of the cigarette is denoted by RT an equivalent resistance which corresponds to the ventilating resistance on the downstream side is denoted by RF as viewed from the direction in which compressed air is entered into the cigarette, an equivalent resistance which corresponds to the ventilating resistance of air passing through the micro-holes formed at the filter section of the cigarette is denoted by RD, pressures of air leaked through the pads between which the cigarette is denoted by RL1 and RL2, detecting pressure blown into the cigarette is denoted by P3, detected pressure of air which is to be entered into the cigarette is denoted by P1, and detected pressure of air which has passed through the cigarette is denoted by P2, $$P2\ \frac{RD\ RL2}{RD(RF+RL2)+RT(RD+RF+RL2)}\ P3$$

When it is assumed that RL2 RF and that RL2 RD, the above-mentioned formula is expressed as follows:

$$P2=RD\times P3\ /\ (RD+RT)$$

When (P1−P2) / P1 is calculated, (P1=P3). Therefore, $$\begin{aligned}\text{dilution } D &= [P3-RD\times P3/(RD+RT)]/P3\\ &= 1-RD/(RD+RT)\\ &= RT/(RD+RT)\end{aligned}$$

On the other hand, the average value operation of the dilution values is carried out in such a way that the average of the dilution values obtained when the dilution drum is rotated one time (or relating to 36 cigarettes) is calculated and that the running average of those value which are obtained on the basis of the calculated average when the drum is rotated 32 times (or relating to 1152 cigarettes) is calculated. Thus running average thus calculated is displayed by the dilution display meter 35. (When the drum is rotated 4000 r.p.m, the running average represents an average of those values obtained for about 17 seconds). This average value is renewed every rotation of the drum.

When the abnormal value presenting that the paper roll of a cigarette is abnormal is detected in the course of carrying out the average value operation, the average value operation is stopped, the value is not used as data and the average value operation is again started relating to a next normal cigarette.

The above-mentioned dilution average value is a running average value obtained except for the following cases at the steps S14 through S19:

(1) A case where the dilution value D detected exceeds its upper limit level DU which represents an abnormal dilution value as seen in step S14;

(2) a case where the dilution value D detected is smaller than its lower limit level DL which denotes an abnormal dilution value as seen in step S15;

(3) a case where the detected value of the measuring pressure P1 is smaller than P1L as seen in step S16 (the cigarette has no paper roll or its paper roll is broken in this case); and (4) a case wherein the pressure P2 of air flowing from the filter side of the cigarette is smaller than P2L (the cigarette has no paper roll or its paper roll is broken in this case).

The cigarettes which come under these cases (1) through (4) are regarded as abnormal ones and all of them are eliminated.

Figure 9B:
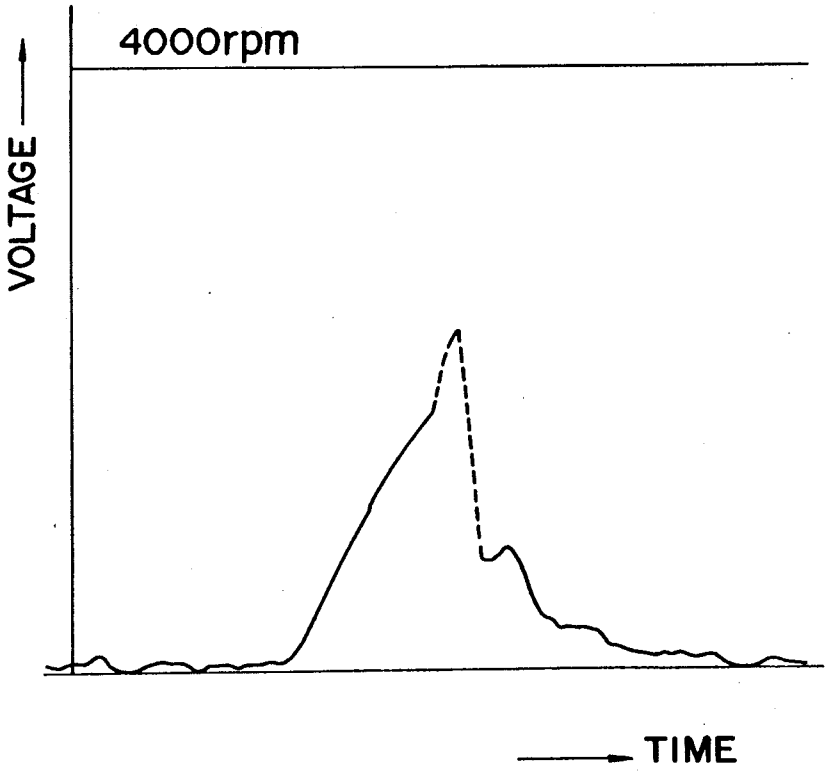
FIGS. 9A and 9B show results measuring by the conventional dilution detecting method.
Figure 9A:
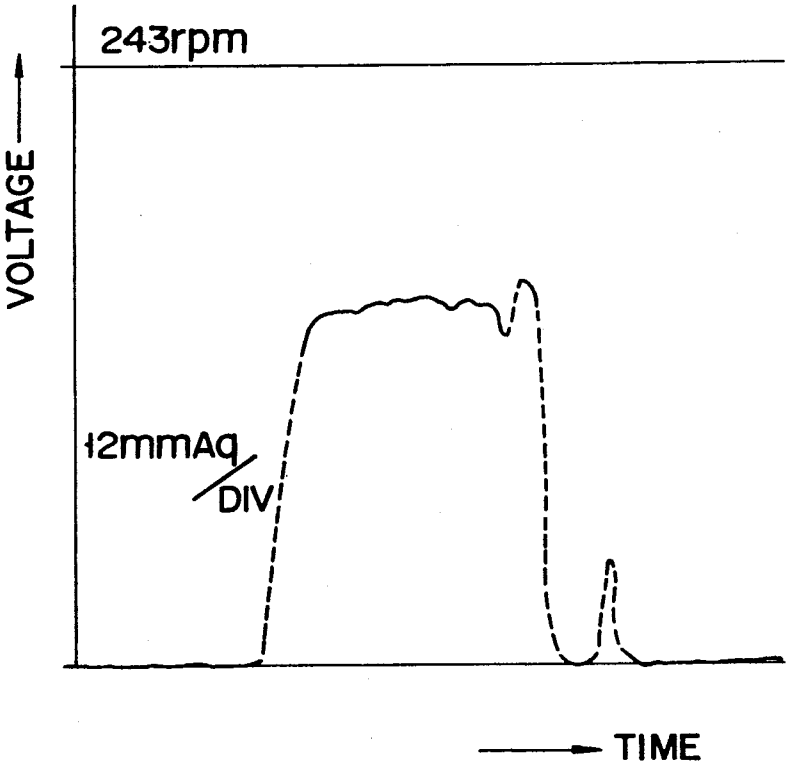
Figure 10B:
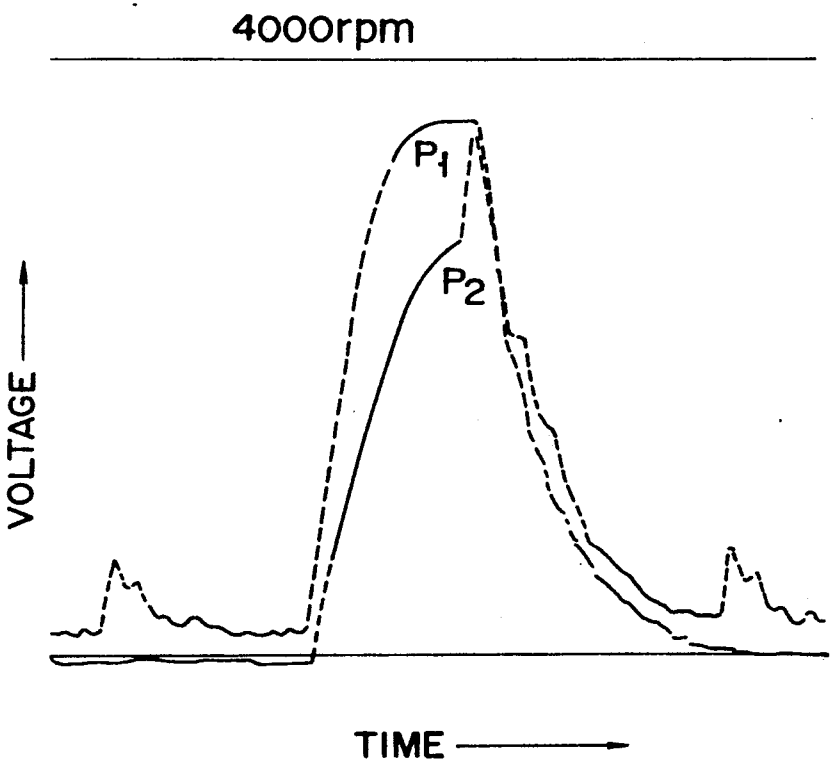
FIGS. 10A and 10B show results measured by the dilution detection method of the present invention.
Figure 10A:
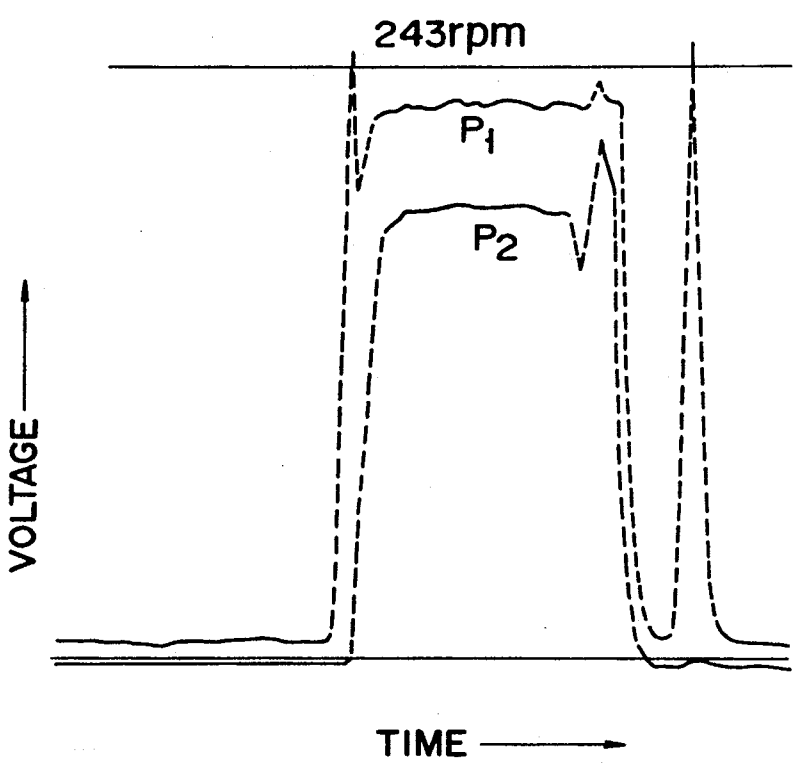

FIGS. 9A and 9B shown results measured according to the conventional dilution measuring method and FIGS. 10A and 10B show results measured according to the dilution measuring method of the present invention. In the case of the conventional measuring method, the measuring pressure is added to the cigarette from both ends thereof without adding the pre-pressure and the reduction of the pressure is detected on the filter side of the cigarette. Therefore, one detected pressure which changes as time goes by is shown as voltage change in each of FIGS. 9A and 9B. On the contrary, pressures P1 and P2 measured on the tobacco and filter sides of the cigarette and changing as time goes by are shown as voltage changes in each of FIGS. 10A and 10B. FIGS. 9A and 10A show results obtained in a case where the cigarettes are carried at a rotation speed of 243 r.p.m., while FIGS. 9B and 10B show results obtained in another case where the cigarettes are carried at a rotation speed of 4000 r.p.m.

As apparent from these graphs, the method of the present invention enables measurement to be accurately achieved even when the rotation speed becomes high. The graphs in FIGS. 9A and 9B tell us that response quickly becomes poor and the peak value is reduced when the rotation speed becomes high, but it can be understood from the graphs in FIGS. 10A and 10B that response does not become poor and the peak value shows no change even when the rotation speed becomes high.

It should be understood that the present invention is not limited to the above-described embodiment and that various modifications and changes can be made depending upon various needs. For example, the present invention is not limited only to the case of forming the micro-holes on the cigarettes, but it may be applied to a case where the micro-holes are formed on rod-like objects.

Accordingly to the present invention, the prepressure is added to the cigarette before the detecting pressure is supplied to it. This makes it easier for the pressure to reach the front end of the cigarette and more accurate pressure can be thus detected even when the cigarettes are carried at a high rotation speed as well as when they are carried at a low rotation speed. Further, air pressures are directly detected on both sides of the cigarette without using any amplifier (or orifice). More accurate dilution values can be thus obtained to thereby make detection accuracy higher.

Additional advantages and modifications will readily occur to those skilled in the art. Thereafter, the invention in its broader aspects is not limited to the specific details, representative devices, and illustrated examples shown and described herein. Accordingly, various modifications may be without departing from the spirit or scope of the general inventive concept as defined by the appended claims and their equivalents.

What is claimed is:

1. A method of detecting a state of micro-holes formed on a rod-like object comprising the steps of:

a) applying a pre-pressure to one end of the rod-like object while keeping the other end of rod-like object closed, in order to obtain a predetermined pressure within the rod-like object;

b) applying a measuring pressure to the rod-like object to the one end of the rod-like object, c) detecting a first saturating pressure at the open end of the rod-like object, converting the first saturating pressure to a first electric signal, detecting a second saturating pressure at the other end of the rod-like object, and converting the second saturating pressure to a second electric signal;

d) processing the first and second electric signals to arithmetically calculate a dilution value of the rod-like object, wherein the pre-pressure applied in step (a) enables the dilution value of the rod-like object to be calculated more accurately in a short period of time;

e) comparing the dilution value with predetermined upper and lower limit values; and f) eliminating the rod-like object if the dilution value is not within a range defined by the predetermined upper and lower limit values by comparing the first and second electric signals with first and second lower limit levels and eliminating the rod-like object if the first and second electric signals are less than the first and second lower limit levels, respectively.

2. The method according to claim 1, wherein said rod-like matter is a filtered cigarette and the state of micro-holes formed at the filter section of the cigarette is detected.

3. The method according to claim 1, wherein said arithmetically calculating step comprises arithmetically calculating dilutions of plural rod-like matters and further arithmetically calculating those measured dilutions which are within the range defined by the predetermined upper and lower limit values to obtain the average of them.

4. The method according to claim 1, wherein $D=(P1-P2 / P1)\times 100\%$ wherein D denotes the dilution, P1 the measuring pressure and P2 the pressure run out of the rod-like matter.

5. The method according to claim 1, wherein said rod-like matter is a cigarette having a filtered section and $D=/ P3=1-RD / (RD+RT)=RT / (RD+RT)$ is established, wherein RT represents ventilating resistance on the upstream side of the and RF ventilating resistance on the down-stream side thereof as viewed from the direction in which compressed air is supplied to the cigarette and wherein RD denotes the ventilating resistance of air passing through the micro-holes formed at the filter section of the cigarette and P3 the detecting pressure blown into the cigarette.

6. The method according to claim 1, further including a step of carrying those rod-like matters whose micro-holes have been examined.

7. An apparatus for detecting a state of micro-holes formed on rod-like objects comprising:

means for successively carrying the rod-like objects;

means for applying a pre-pressure to one end of the rod-like objects while keeping the other end of the rod-like objects closed in order to obtain a predetermined pressure within the rod-like objects;

means for applying a measuring pressure to the rod-like objects, to which the pre-pressure has been applied, through one end of the rod-liked objects;

first detector means for detecting a first saturating pressure at the one end of the rod-like objects and converting the first saturating pressure to a first electric signal;

second detector means for detecting a second saturating pressure at the other end of the rod-like objects and converting the second saturating pressure to a second electric signal;

means for processing the first and second electric signals to arithmetically calculate a dilution value for each of said rod-like objects, including means for storing first and second lower limit levels and means for comparing the first and second electric signals with the first and second lower limit levels, respectively, wherein the pre-pressure applied by said means for applying a pre-pressure enables the dilution value of the rod-like objects to be calculated more accurately in a short period of time.

8. The apparatus according to claim 7, wherein said rod-like matter is a filtered cigarette and the state of the micro-holes formed at the filter section of the cigarette is detected or examined.

9. The apparatus according to claim 7, further comprising means for forming plural micro-holes round the rod-like matter by laser beam.

10. The apparatus according to claim 7, wherein said carrying means includes means for rotating the rod-like matters.

11. The apparatus according to claim 10, wherein said carrying means includes means for causing members to be contacted with both ends of the rod-like matter to hold it between them.

12. The apparatus according to claim 11, wherein said causing means has passages through each of which the pre-pressure and the measuring pressure are applied to the rod-like matter through one end of the matter.

13. The apparatus according to claim 10, wherein said carrying means includes a rotating body and means for sucking and holding the rod-like matters on this rotating body.

14. The apparatus according to claim 6, wherein said processing means includes means for storing predetermined upper and lower limit values and comparing these upper and lower limit values with the arithmetically calculated dilutions of the rod-like matters.

15. The apparatus according to claim 14, further comprising means for eliminating those rod-like matters whose dilutions are out of a range defined by the predetermined upper and lower limit values.

16. The apparatus according to claim 7, further comprising means for eliminating those rod-like matters whose first and second electric signals are smaller than the first and second lower limit levels.

17. The apparatus according to claim 7, wherein said processing means serves to arithmetically calculate the dilutions of the plural rod-like matters and to further arithmetically calculate those measured dilutions which are within the range defined by the predetermined upper and lower limit values so as to obtain the average of them.

18. The apparatus according to claim 7, wherein $D=(P1-P2 / P1)\times 100\%$ in which D represents the dilution obtained relating to the rod-like matter, P1 the measuring pressure and P2 the pressure run out of the rod-like matter.

19. The apparatus according to claim 7, wherein $D=/P3=1-RD / (RD+RT)=RT / (RD+RT)$, in which RT denotes ventilating resistance on the upstream side of the cigarette and RF ventilating resistance on the downstream side thereof as viewed from the direction of supplying compressed air into the cigarette and in which RD denotes the ventilating resistance of air passing through the micro-holes formed at the filter section of the cigarette and P3 the detecting pressure blown into the cigarette.

* * * * *